US008418620B2

(12) United States Patent
Frank

(10) Patent No.: US 8,418,620 B2
(45) Date of Patent: Apr. 16, 2013

(54) SHOT CUP FOR SHOTSHELL

(75) Inventor: Ben N. Frank, Worden, IL (US)

(73) Assignee: Olin Corporation, East Alton, IL (US)

( * ) Notice: Subject to any disclaimer, the term of this patent is extended or adjusted under 35 U.S.C. 154(b) by 0 days.

(21) Appl. No.: 13/233,384

(22) Filed: Sep. 15, 2011

(65) Prior Publication Data

US 2012/0067243 A1 Mar. 22, 2012

Related U.S. Application Data

(60) Provisional application No. 61/384,000, filed on Sep. 17, 2010.

(51) Int. Cl.
*F42B 7/00* (2006.01)

(52) U.S. Cl.
USPC ..... 102/449; 102/457

(58) Field of Classification Search ..... 102/448, 102/449, 457, 456, 450, 451, 452, 453, 461, 102/462, 463, 438, 502
See application file for complete search history.

(56) References Cited

U.S. PATENT DOCUMENTS 6,260,484 B1 * 7/2001 Billings ..... 102/453
6,367,388 B1 * 4/2002 Billings ..... 102/454

* cited by examiner

*Primary Examiner* — Stephen M Johnson
*Assistant Examiner* — John D Cooper
(74) *Attorney, Agent, or Firm* — Harness, Dickey & Pierce, P.L.C.

(57) ABSTRACT

A shot cup for holding shot in a shotshell has a generally cylindrical sidewall, having a closed proximal end, and an open distal end, and at least one distally-facing petal connected to the sidewall at its proximal end, the petal configured so that it is widest at a point intermediate the proximal and distal ends of the petal. The at least one petal being capable of opening outwardly after the shot cup leaves the shotshell.

15 Claims, 9 Drawing Sheets

SHOT CUP FOR SHOTSHELL

CROSS-REFERENCE TO RELATED APPLICATIONS

This application claims priority to U.S. Provisional Patent Application Ser. No. 61/384,000, filed Sep. 17, 2010, the entire disclosure of which is incorporated herein.

BACKGROUND

This section provides background information related to the present disclosure which is not necessarily prior art.

This invention relates to shotshells, and in particular for a wad or shot cup for holding the shot in a shot shell.

A shotshell typically comprises a casing with a head at one end. A load of shot is disposed inside the casing. A propellant is also disposed in the casing, behind the load of shot, to propel the shot from the shell when the shotshell is fired. Usually a wad is provided between the propellant and the load to protect the shot and/or improve the shot pattern. One type of wad is a shot cup, which is a cup for holding the load of shot. The cup helps protect the shot and the shot gun barrel as the load is expelled from the shell. The cups are often intended to help guide the load and improve the shot pattern, but because of difficulties in separating the shot from the cup, the cup often impairs the shot pattern.

SUMMARY

This section provides a general summary of the disclosure, and is not a comprehensive disclosure of its full scope or all of its features.

Embodiments of the present invention provide an improved wad or shot cup for holding a load of shot in a shotshell. These embodiments include petals that can readily and reliably extend from the shot cup to facilitate the separation of the shot from the shot cup while minimizing interference with the flight path of the shot.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

A preferred embodiment of a wad for a shotshell, in the form of a shot cup, is indicated as 20 in FIGS. 1-14. The shot cup 20 comprises a generally cylindrical sidewall 22, with a closed proximal end 24, and an open distal end 26.

Figure 1:
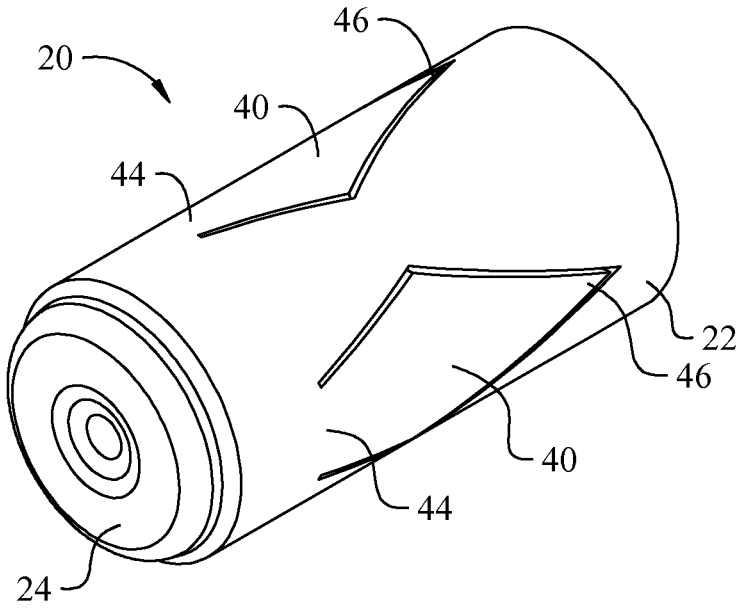
FIG. 1 is a perspective view of the proximal end of a shot cup, according to a preferred embodiment of this invention.
Figure 2:
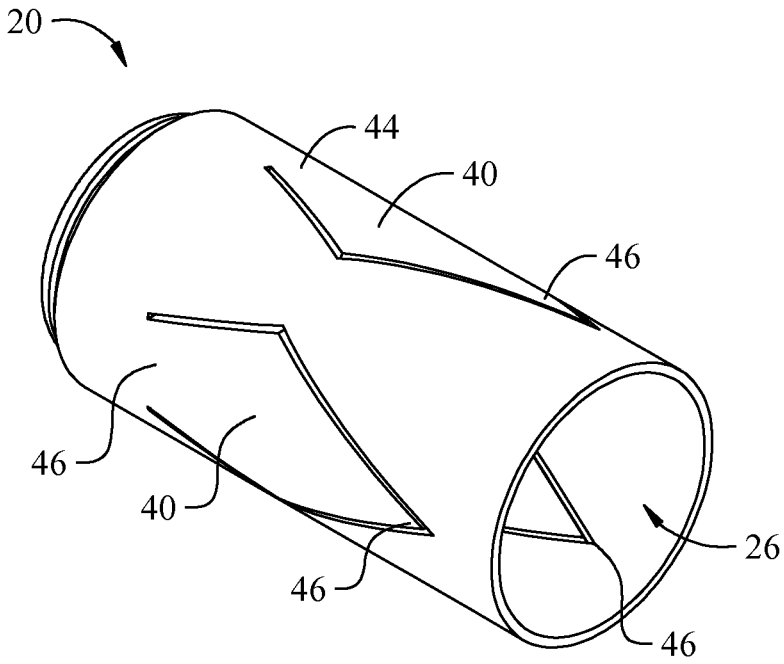
FIG. 2 is a perspective view of the distal end of the shot cup.
Figure 3:
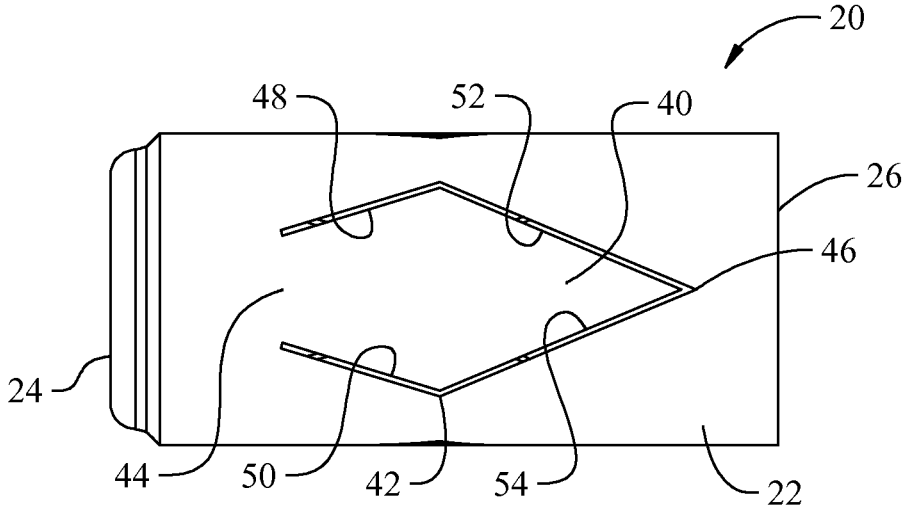
FIG. 3 is a side elevation view of the shot cup.
Figure 4:
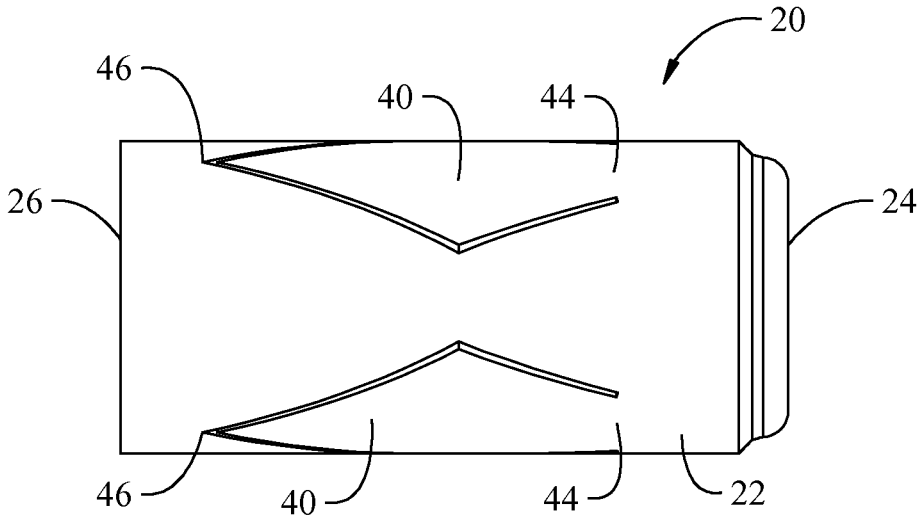
FIG. 4 is a side elevation view of the shot cup from the opposite side shown in FIG. 3.
Figure 5:
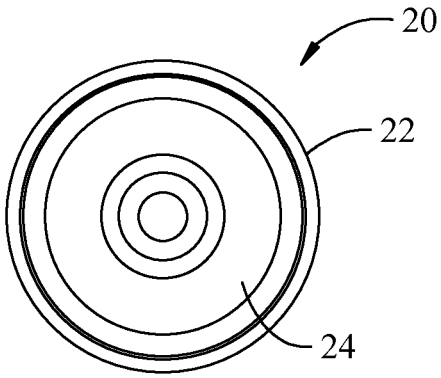
FIG. 5 is a proximal end elevation view of the shot cup.
Figure 6:
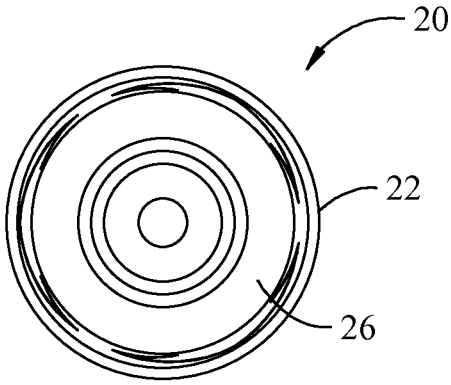
FIG. 6 is a distal end elevation view of the shot cup.
Figure 7:
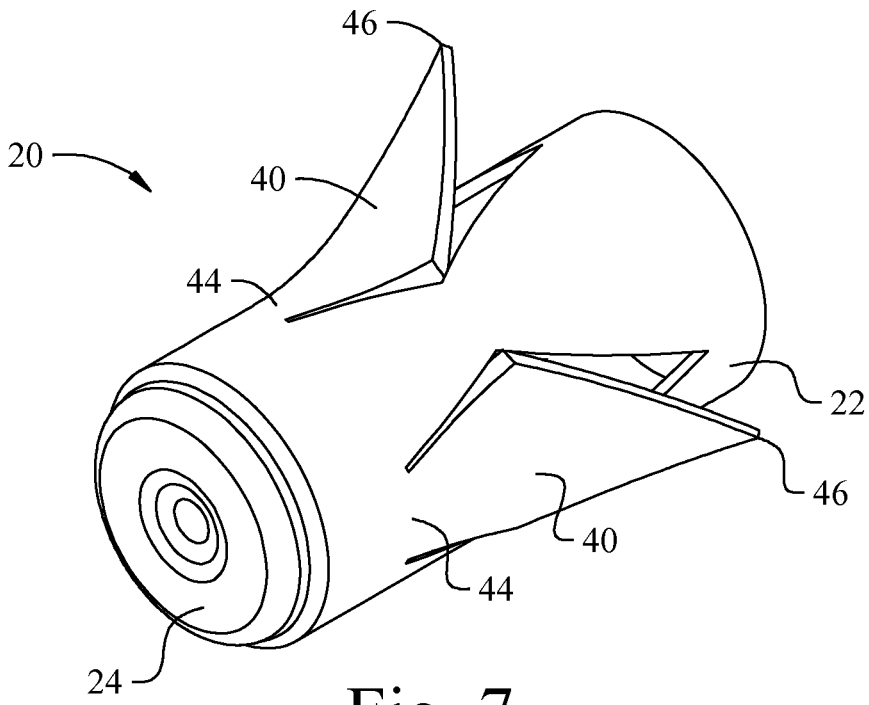
FIG. 7 is a perspective view of the proximal end of the shot cup, with the petals deployed.
Figure 8:
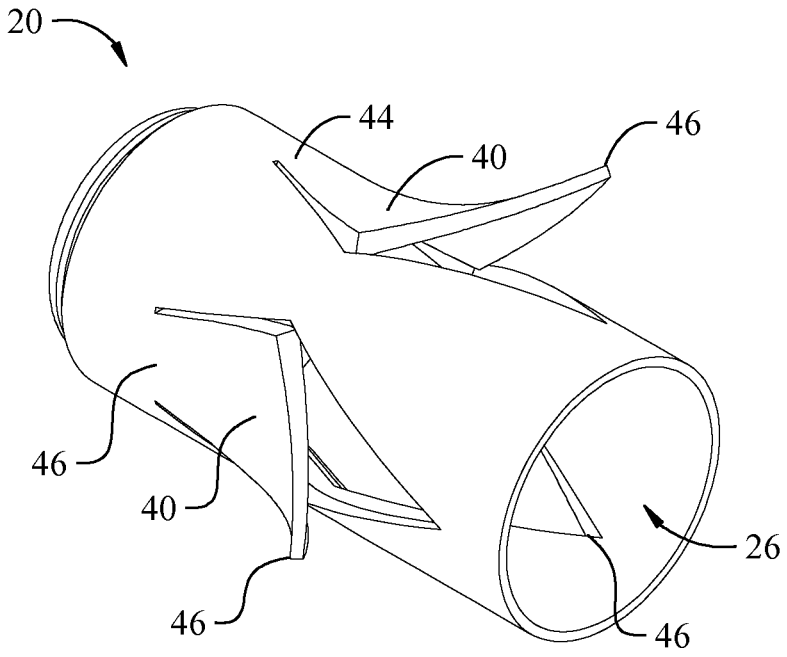
FIG. 8 is a perspective view of the distal end of the shot cup, with the petals deployed.
Figure 9:
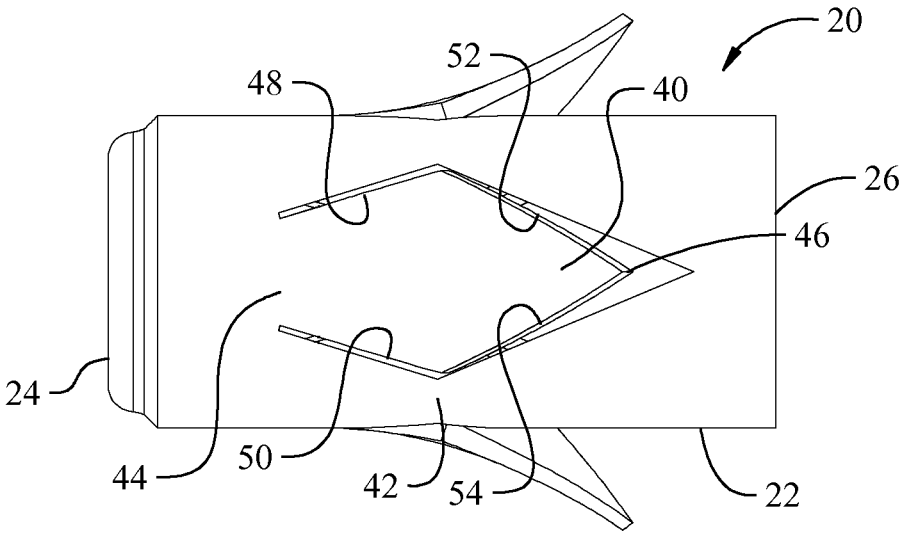
FIG. 9 is a side elevation view of the shot cup, with the petals deployed.
Figure 10:
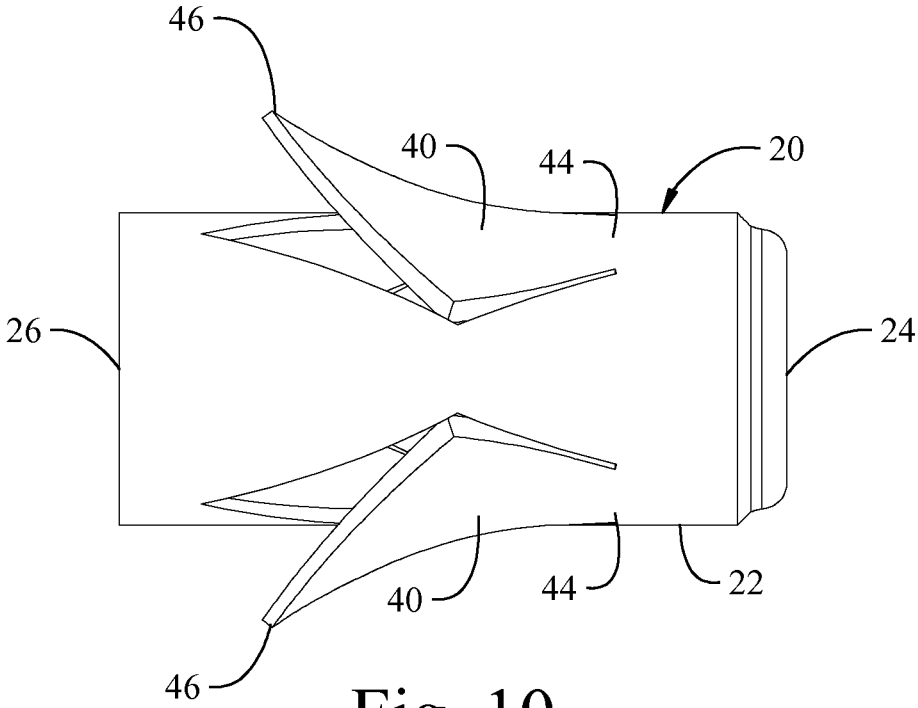
FIG. 10 is a side elevation view of the shot cup from the opposite side shown in FIG. 9, with the petals deployed.
Figure 11:
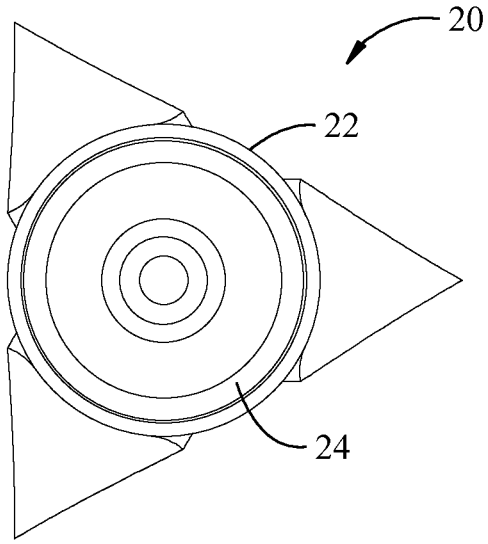
FIG. 11 is a proximal end elevation view of the shot cup, with the petals deployed.
Figure 12:
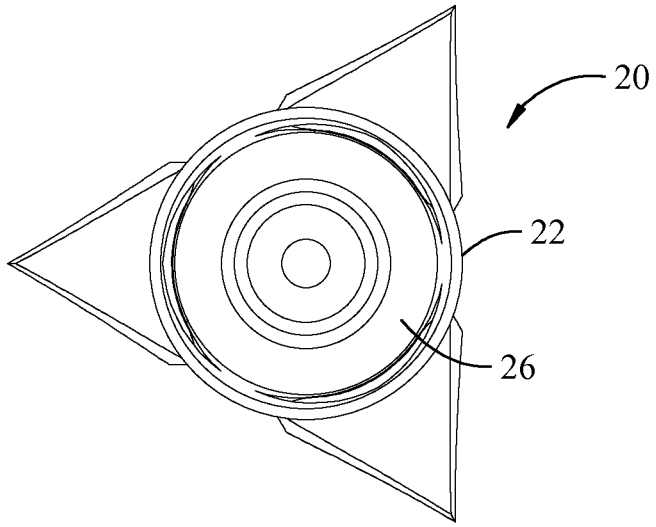
FIG. 12 is a distal end elevation view of the shot cup, with the petals deployed.
Figure 13:
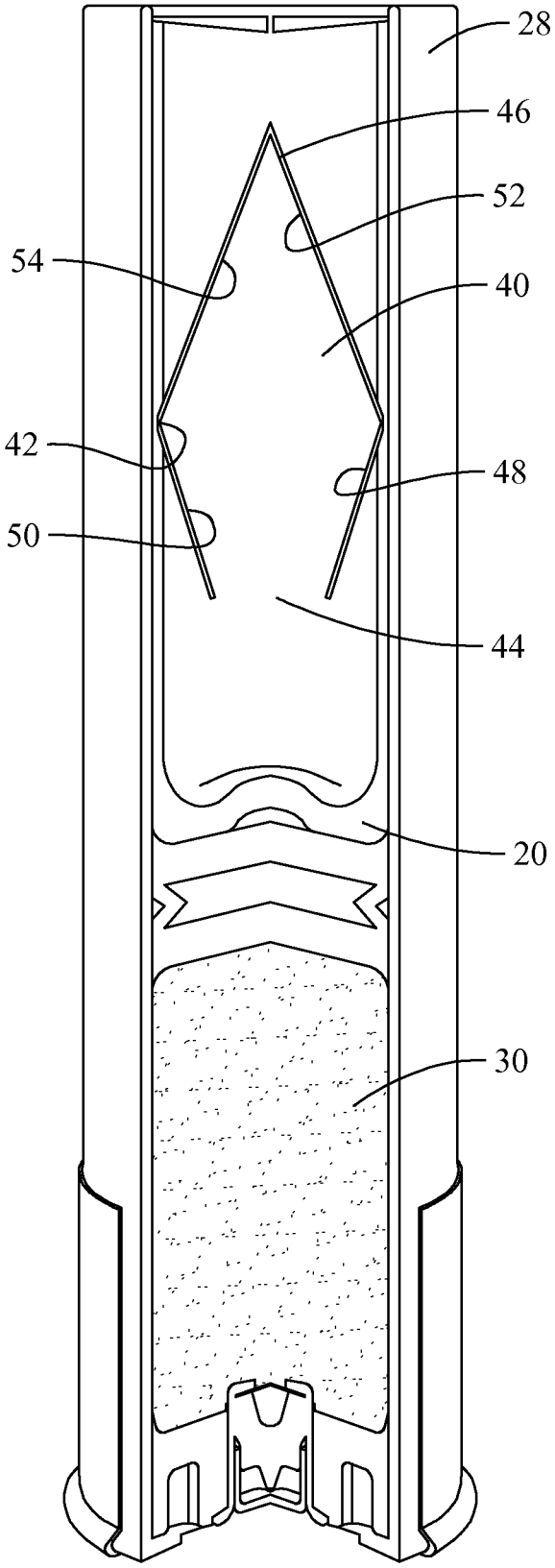
FIG. 13 is a side elevation view with a section removed to show the details of construction of a shotshell incorporating a shot cup of the preferred embodiment, with the shot removed to show the details of the shot cup.
Figure 14:
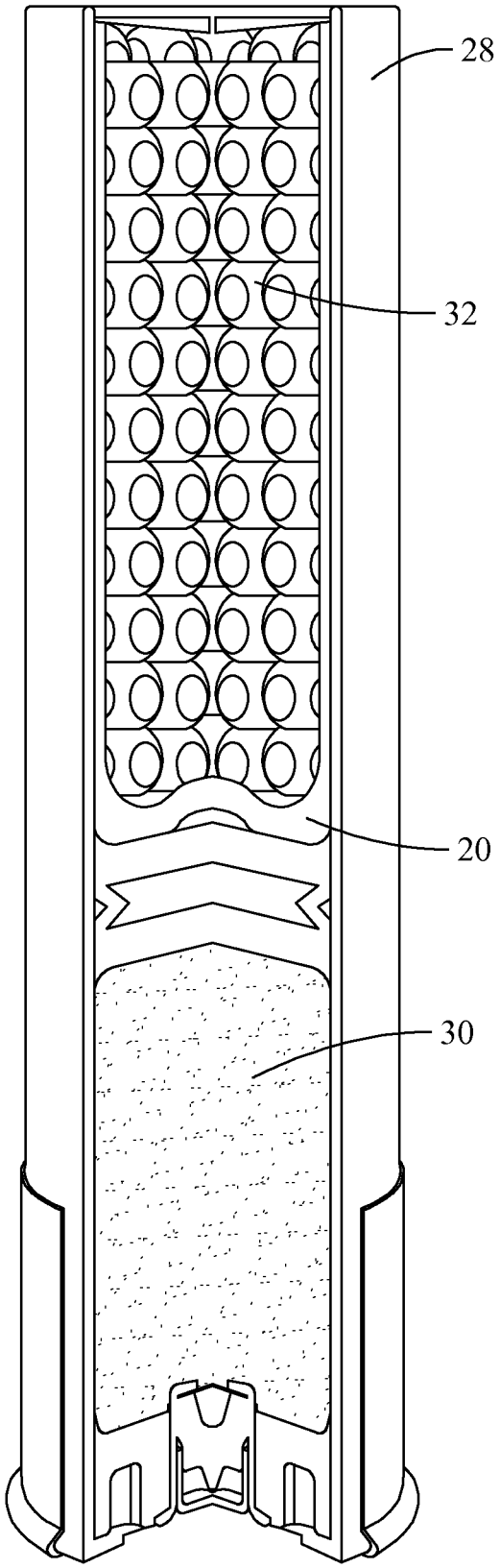
FIG. 14 is a side elevation view with a section removed to show the details of construction of a shotshell incorporating a shot cup of the preferred embodiment.

As shown in FIGS. 13 and 14, the shot cup 20 is adapted to be positioned inside the casing 28 of a shotshell, in front of the propellant charge 30, to hold a load of shot 32. As is known, the shotshell can comprise a metal head joined to the casing at 28, and having a primer mounted therein for igniting the propellant charge 30. One or more wads can be provided between the propellant 30 and the shot cup 20 to protect the shot cup and ensure that the shot cup is properly discharged from the shell. When the shotshell is fired, the cup 20 and its load of shot 32 are propelled from the distal end of the shotshell, and out of the barrel of the shot gun. At some point after leaving the barrel of the shot gun, the shot cup 20 and its load of shot 32 separate, and the shot in the load begin to disperse into a pattern.

The shot cup 20 preferably comprises at least one, and preferably a plurality of distally-facing petals 40 formed therein, that deploy after the shot cup 20 leaves the casing 28 of the shotshell. In the preferred embodiment, there are three petals 40, but there could be fewer or more petals if desired. These petals 40 are preferably substantially evenly spaced about the circumference of the shot cup 20.

The petals 40 are preferably widest at some point 42 intermediate their proximal end 44 and their distal end 46. The petals 40 can be any shape, but in this preferred embodiment, they are generally diamond-shaped, with side edges 48 and 50 that diverge from the proximal end 44 toward the distal end 46, and side edges 52 and 54 that converge toward the distal end 46. In this preferred embodiment, the width of the petal 40 at its widest point ($w_w$ in FIG. 3) is between about 1.5 and 2.5 times the width of the petal at its proximal end ($w_p$ in FIG. 3), and more preferably about 2 times the width of the petal at its proximal end. Furthermore, the width of the petal 40 at its proximal end 44 ($W_p$) is preferably between about 25% and about 40% of the diameter of the shot cup, and preferably about 33% of the diameter of the shot cup. These dimensions help ensure that the petals 40 open up reliably and timely separate the shot cup 20 from the load of shot carried inside the shot cup.

While the petals 40 are shown as generally diamond-shaped, alternatively the petals could be leaf-shaped, lens-shaped, or some other shape where the petal is wider intermediate the ends than it is at the ends.

This configuration provides several benefits: First, the relatively narrow width at the proximal ends of the petals means that the petals can relatively easily deploy from the sidewall, despite the curvature of the generally cylindrical sidewall. Second, the relatively large width of the petals intermediate their proximal and distal ends means that the petals more easily catch the air, further facilitating the deployment of the petals 40. Third, the relatively narrow configuration of the petals 40 near their distal ends means more of the rim of the cup adjacent the distal end 46 of the cup 20 is intact, helping to control and retain the shot therein.

The cup 20 is preferably made of a plastic, such as polyethylene. The petals 40 are preferably formed by cuts entirely through the sidewall 22 so that the petals readily open, but the petals could be formed by lines of weakness in the sidewalls, such as score lines or perforations.

Figure 15:
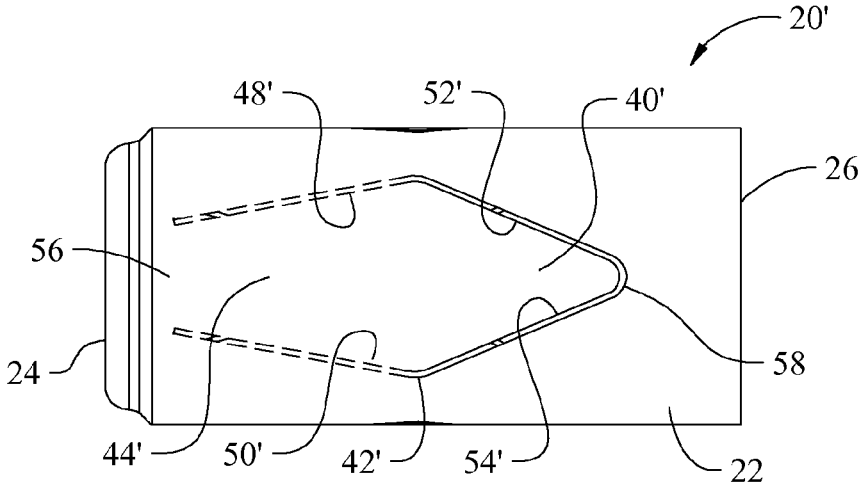
FIG. 15 is a side elevation view of a first alternate construction of a shot cup, showing a petal with a rounded distal tip and which extends to adjacent the bottom of the cup.

A first alternate construction of the shot cup 20 is indicated as 20' in FIG. 15. Shot cup 20' is similar in construction to shot cup 20, and corresponding parts are identified with corresponding reference numerals. However, the tip 58 of the petal 40' is rounded in shot cup 20' rather than pointed as is petal 40 of shot cup 20. This rounded tip 58 on petal 40' makes it less likely to bind, and thus, the petal more easily and reliably deploys. With multiple petals it is often particularly desirable that all the petals deploy uniformly and consistently, so that the shot cop is less prone to wobbling and thus, less likely to impair the release of shot from the shot cup.

Another difference between shot cup 20' and shot cup 20 is that the base 56 of the petal 40' is closer to the end of the cup than the base of the petal 40. In at least some configurations, the longer petals 40' open more easily and reliably. With multiple petals, it is often particularly desirable that all the petals deploy uniformly and consistently, so that the shot cop is less prone to wobbling and thus, less likely to impair the release of shot from the shot cup.

Figure 16:
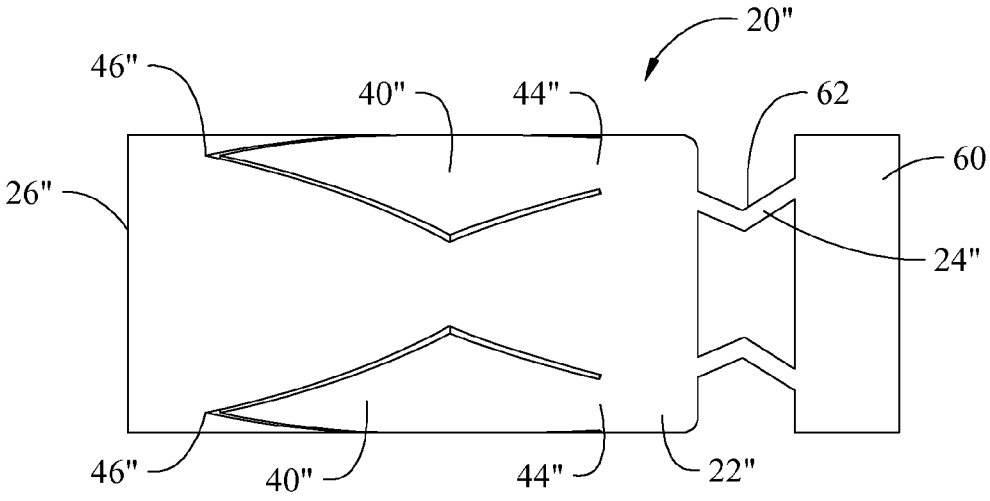
FIG. 16 is a side elevation view of a second alternate construction of a shot cup, incorporating a powder cup hingedly connected to the shot cup.

A second alternate construction of the shot cup 20 is indicated as 20" in FIG. 16. Shot cup 20" is similar in construction to shot cup 20, and corresponding parts are identified with corresponding reference numerals. However, shot cup 20" further comprises a powder cup 60 connected to the base of the cup 20" with a hinge 62. This hinge 62 is not limited to the particular type of hinge shown, and can be any hinge or other connector used for joining a powder cup with a shot cup or similar wad.

Operation

In operation when a shotshell, including the shot cup 20, is fired, the shot cup 20 and its load of shot 32 are propelled from the shell, and out of the barrel of the shot gun. Once the shot cup 20 is free from the barrel of the shot gun, the petals 40 can expand. The configuration of the petals, and in particular the large cross sectional area in between the proximal and distal ends of each petal, and the small length of the connection of the petal at its proximal end, facilitate the deployment of the petals. Once the petals 40 deploy, the shot cup 20 will slow relative to the load of shot 32 contained therein, facilitating the separation of the shot from the shot cup 20. The petals 40 facilitate this separation before the shot cup 20 can tip or tilt, and either trap shot in the shot cup, or deflect the shot from an evenly dispersed shot pattern.

The foregoing description of the embodiments has been provided for purposes of illustration and description. It is not intended to be exhaustive or to limit the disclosure. Individual elements or features of a particular embodiment are generally not limited to that particular embodiment, but where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed:

1. A shot cup for holding shot in a shotshell, the shot cup comprising a generally cylindrical sidewall, having a closed proximal end, and an open distal end, and a plurality of distally-facing petals connected to the sidewall at its proximal end, the petal configured so that it is widest at a point intermediate the proximal and distal ends of the petal, the at least one petal being capable of opening outwardly after the shot cup leaves the shotshell.

2. The shot cup according to claim 1 wherein the plurality of petals are substantially equally spaced around the circumference of the sidewall of the shot cup.

3. The shot cup according to claim 1 wherein there are three petals.

4. The shot cup according to claim 1 wherein each of the petals are of substantially the same size and shape.

5. The shot cup according to claim 4 wherein the plurality of petals are substantially equally spaced around the circumference of the sidewall of the shot cup.

6. The shot cup according to claim 1 wherein each petal is substantially diamond-shaped, with side edges that diverge in the distal direction to a point intermediate the proximal and distal ends of the petal, and thereafter converge toward the distal end of the petal.

7. The shot cup according to claim 1 wherein the petals are formed by lines of weakness in the sidewall of the shot cup.

8. The shot cup according to claim 7 wherein the lines of weakness are formed by perforations in the sidewall of the shot cup.

9. The shot cup according to claim 7 wherein the lines of weakness are formed by score lines in the sidewall of the shot cup.

10. The shot cup according to claim 1 wherein each petal is formed by at least one cut in the sidewall of the shot cup.

11. The shot cup according to claim 1 wherein each petal is formed by one continuous cut in the sidewall of the shot cup.

12. The shot cup according to claim 1 wherein the petals are hingedly attached to the sidewall at their proximal ends, and wherein the petals are wider at a point intermediate their proximal or distal ends, than the width of the hinged attachment.

13. A shot cup for holding shot in a shotshell, the shot cup comprising a generally cylindrical sidewall, having a closed proximal end, and an open distal end, and a plurality of distally-facing petals connected to the sidewall at their proximal ends, the petals being widest at a point intermediate their proximal and distal ends, and the petals being substantially equally spaced around the circumference of the sidewall, each of the petals being capable of opening outwardly after the shot cup leaves the shotshell.

14. A shot cup for holding shot in a shotshell, the shot cup comprising a generally cylindrical sidewall, having a closed proximal end, and an open distal end, and a plurality of distally-facing petals connected to the sidewall at their proximal ends, the petals being wider at a point distal to the point of connection than the width of the connection at the proximal end, and the petals being substantially equally spaced around the circumference of the sidewall, each of the petals being capable of opening outwardly after the shot cup leaves the shotshell.

15. A shotshell comprising:

a shell case;

a head at the proximal end of the shall case;

a shot cup disposed in the shell case, the shot cup comprising a generally cylindrical sidewall, having a closed proximal end and an open distal end, and a plurality of distally-facing petals connected to the sidewall at its proximal end, the at least one petal being widest at a point intermediate its proximal and distal ends, and being capable of opening outwardly after the shot cup leaves the shotshell; and a load of shot disposed in the shot cup.

* * * * *